US007840157B2

(12) United States Patent
Nakatake et al.

(10) Patent No.: US 7,840,157 B2
(45) Date of Patent: Nov. 23, 2010

(54) IMAGE FORMING APPARATUS AND IMAGE CARRIER UNIT

(75) Inventors: Naoki Nakatake, Hyogo (JP); Hidekazu Shono, Hyogo (JP); Takeshi Yamashita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 389 days.

(21) Appl. No.: 11/944,868

(22) Filed: Nov. 26, 2007

(65) Prior Publication Data

US 2008/0131162 A1 Jun. 5, 2008

(30) Foreign Application Priority Data

Dec. 4, 2006 (JP) ..... 2006-326994

(51) Int. Cl.

| | |
|---|---|
| ***G03G 15/16*** | (2006.01) |
| ***G03G 15/20*** | (2006.01) |
| ***G03G 15/01*** | (2006.01) |
| ***G03G 21/00*** | (2006.01) |

(52) U.S. Cl. ..... 399/101; 399/123; 399/302; 399/344; 399/349; 399/351; 399/353; 399/357

(58) Field of Classification Search ..... 399/101, 399/123, 302, 343, 344, 349, 351, 353, 357
See application file for complete search history.

(56) References Cited

U.S. PATENT DOCUMENTS

| | | | | |
|---|---|---|---|---|
| 6,983,840 | B2 | 1/2006 | Yamazaki et al. | |
| 7,020,415 | B2 * | 3/2006 | Nobumasa | 399/110 |
| 2005/0084282 | A1 * | 4/2005 | Yamada et al. | 399/101 |
| 2005/0284778 | A1 | 12/2005 | Yamazaki et al. | |
| 2007/0147893 | A1 | 6/2007 | Nakatake et al. | |

FOREIGN PATENT DOCUMENTS

| | | |
|---|---|---|
| JP | 2000-293044 | 10/2000 |
| JP | 2005-181820 | 7/2005 |

OTHER PUBLICATIONS

U.S. Appl. No. 12/187,021, filed Aug. 6, 2008, Shono, et al.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

To improve the user maintainability and cost performance with respect to replacing replaceable components in an image forming apparatus using a tandem type intermediate transfer member. In an image forming apparatus provided with: primary transfer rollers that successively transfer toner images formed on a plurality of photosensitive members to an intermediate transfer belt on a surface of which the images are moved; and a secondary transfer roller that transfers in one operation the toner image on the intermediate transfer belt to a recording medium, and the plurality of photosensitive members are formed as a plurality of image carrier units that are removable with respect to the main body of the image forming apparatus, a belt cleaning member that cleans secondary transfer residual toner from the intermediate transfer belt is disposed upstream, relative to the direction of movement of the surface of the intermediate transfer belt, of the image carrier unit that is disposed uppermost in the upstream direction, and the belt cleaning member is capable of being integrally removed.

12 Claims, 4 Drawing Sheets

IMAGE FORMING APPARATUS AND IMAGE CARRIER UNIT

BACKGROUND OF THE INVENTION

1. Field of the Invention

The present invention relates to an image forming apparatus, such as a copying machine, facsimile, printer, or the like, and an image carrier unit used therein.

2. Description of the Related Art

Color is becoming more common in this type of image forming apparatus, in response to market requirements. One example is the widely used so-called tandem type image forming apparatus. In the tandem type image forming apparatus, a plurality of photosensitive members as image carriers and toner image forming means for forming toner images on the photosensitive members are provided and arranged Single color toner images formed on each photosensitive member are successively transferred and superimposed to form a color image. Also, tandem type image forming apparatus in which frames are provided for the plurality of photosensitive members, either individually or integrated with the toner image forming means, to form a plurality of photosensitive member units, are widely used. In this way the plurality of photosensitive member units can be removed from the main body of the image forming apparatus via the frames. Therefore, the photosensitive members and toner image forming means can be easily replaced in accordance with their life.

Also, Japanese Patent Application Laid-open No. 2000-293044 discloses a system that uses an intermediate transfer member, such as an intermediate transfer belt, as a transfer system used in the tandem type image forming apparatus. In this transfer system, toner images formed on the photosensitive members are transferred and superimposed onto the surface of a moving intermediate transfer belt in a primary transfer operation. Then the superimposed toner image is transferred onto the recording medium from the intermediate transfer belt in a secondary transfer operation. Also, intermediate transfer member cleaning means is provided for removing secondary transfer residual toner from the intermediate transfer belt after the secondary transfer of the superimposed image on the intermediate transfer belt to the recording medium, so that the next image forming operation is not affected.

The intermediate transfer belt and the intermediate transfer cleaning means must be replaced in accordance with their life, so they are designed to be removable from the main body of the image forming apparatus. However, the replacement procedure is complex for image forming apparatus that is structured so that both the intermediate transfer belt and the intermediate transfer cleaning means are individually removed for replacement. Therefore, when either the intermediate transfer belt or the intermediate transfer cleaning means are to be replaced, normally a special serviceperson carries out the operation. By calling on a service person to carry out all the replacements, a personnel cost is incurred every time a call is made, which results in increasing the replacement cost. Also, users that do not call on a service person but carry out the replacement themselves, must individually remove the parts when both the intermediate transfer belt and the intermediate transfer cleaning means are changed, and this leads to an increased operational burden.

On the other hand, as shown in Japanese Patent Application Laid-open No. 2005-181820, the replacement procedure is simplified by changing the intermediate transfer belt and the intermediate transfer member cleaning means as a unit, so an ordinary user can carry out the replacement. However, the life of the intermediate transfer cleaning means is significantly shorter compared with the intermediate transfer belt, and must be changed more frequently. Therefore if the intermediate transfer belt is replaced in accordance with the shorter life of the intermediate transfer cleaning member means, the problem of waste of components and poor cost performance arises.

SUMMARY OF THE INVENTION

With the foregoing background in view, it is an object of the present invention to provide an image forming apparatus using a tandem type intermediate transfer member capable of improving the user maintainability and cost performance for replacing replaceable components.

In an aspect of the present invention, an image forming apparatus comprises a plurality of image carriers; a toner image forming device for forming toner images on the plurality of image carriers respectively; a primary transfer device for transferring successively the toner images formed on the plurality of image carriers onto an intermediate transfer member whose surface moves; a secondary transfer device for transferring to a recording medium the toner images on the intermediate transfer member, on a surface of which the images are moved, in one operation; and an intermediate transfer member cleaning device, which is in contact with the intermediate transfer member, for cleaning secondary transfer residual toner. The plurality of image carriers is in a form of a plurality of image carrier units that can each be removed from or inserted into a main body of the image forming apparatus. The intermediate transfer member cleaning device is disposed upstream, relative to the direction of movement of the surface of the intermediate transfer member, of the image carrier unit that is disposed uppermost in the upstream direction, and the intermediate transfer member cleaning device is capable of being integrally removed from the main body of the image forming apparatus. In another aspect of the present invention, an image forming apparatus comprises a plurality of image forming carriers; a toner image forming device configured to form toner images on the plurality of image carriers respectively; a primary transfer device configured to transfer successively the toner images formed on the plurality of image carriers onto an intermediate transfer member whose surface moves; a secondary transfer device configured to transfer to a recording medium the toner images on the intermediate transfer member, on a surface of which the images are moved, in one operation; and an intermediate transfer member cleaning device, which is in contact with the intermediate transfer member, and is configured to clean secondary transfer residual toner. The plurality of image carriers is in a form of a plurality of image carrier units that can each be removed from or inserted into a main body of the image forming apparatus. The intermediate transfer member cleaning device is disposed upstream, relative to the direction of movement of the surface of the intermediate transfer member, of the image carrier unit that is disposed uppermost in the upstream direction, and the intermediate transfer member cleaning means is capable of being integrally removed from the main body of the image forming apparatus

BRIEF DESCRIPTION OF THE BRIEF DRAWINGS

The above and other objects, features, and advantages of the present invention will become more apparent from the following detailed description taken with the accompanying drawings in which.

DESCRIPTION OF THE PREFERRED EMBODIMENTS

In the present invention, by providing intermediate transfer cleaning means within an image carrier unit that can be removed from the main body of the image forming apparatus, the intermediate transfer cleaning means can be easily replaced without also replacing the image carrier unit. Also, with this arrangement it is possible to reduce the occurrence of waste of components compared with the case where the intermediate transfer cleaning means is replaced integrally with the image carrier unit, because normally the life of the intermediate transfer cleaning means is shorter than that of the image carrier.

The following is an explanation of an embodiment of an image forming apparatus that applies the present invention.

First, the structure and operation of a tandem indirect transfer system image forming apparatus according to the present invention is explained.

Figure 1:
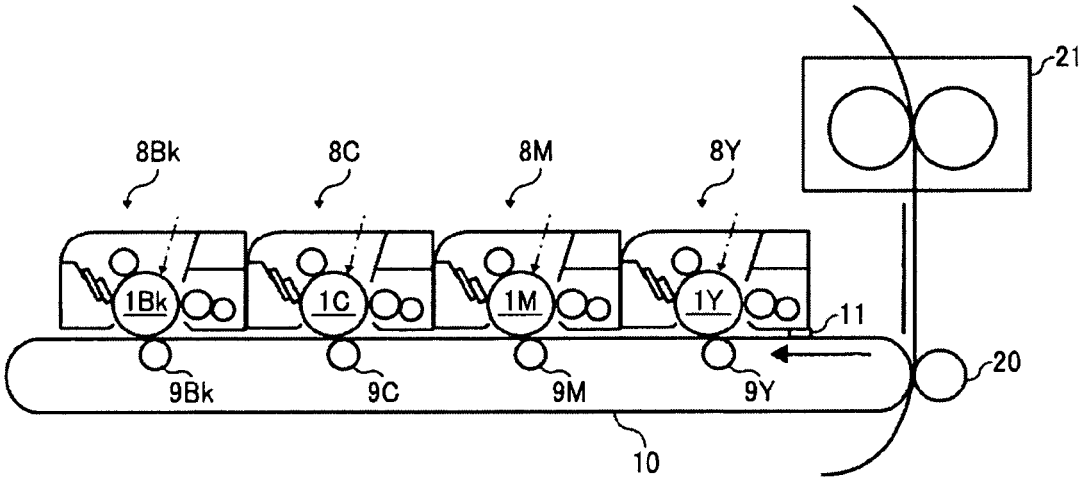
FIG. 1 is a diagram showing the outline structure of an image forming apparatus with a tandem indirect transfer system according to the present embodiment.

FIG. 1 shows a diagram of the outline structure of the overall tandem indirect transfer system image forming apparatus according to the present invention. The image forming apparatus in FIG. 1 includes an intermediate transfer belt 10 as intermediate transfer member, having an endless surface that moves in the direction of the arrow in the figure. Four drum-shaped photosensitive members 1Y, M, C, Bk that carry yellow, magenta, cyan, and black (hereafter indicated by Y, M, C, and Bk respectively) toner images are provided above the intermediate transfer belt 10, arranged in that order from the upstream side in the direction of rotation of the intermediate transfer belt 10. Toner image forming means that form toner images in the respective colors are disposed around the photosensitive members 1Y, M, C, Bk, supported integrally by frames to form image carrier units 8Y, M, C, Bk which can be removed from the main body of the image forming apparatus.

Also, an optical writing device (not shown in the drawings) is disposed above the photosensitive members 1Y, M, C, Bk, that forms electrostatic latent images for the Y, M, C, K colors on the photosensitive members 1Y, M, C, K, by scanning laser light generated based on the image information onto the surfaces of the photosensitive members 1Y, M, C, Bk. Also, primary transfer rollers 9Y, M, C, Bk are provided on the inside of the intermediate transfer belt 10 in opposition to the photosensitive members 1Y, M, C, Bk, as primary transfer means for transferring the toner images formed on each of the photosensitive members 1Y, M, C, Bk onto the intermediate transfer belt 10.

Also, a secondary transfer roller 20 is provided as secondary transfer means downstream of the image carrier units 8Y, M, C, Bk in the direction of rotation of the intermediate transfer belt 10, for transferring the image on the intermediate transfer belt 10 onto the recording medium. Also, a fixing device 21 is provided downstream of the secondary transfer roller 20 in the direction of transport of the recording medium, for fixing the unfixed toner onto the recording medium.

The toner image forming means of each color contains toner in mutually different colors (Y, M, C, Bk) as the substance for forming images, but otherwise have the same structure. Therefore, in the following the structure and operation of the toner image forming means for forming the Y toner image is explained, and the explanation for the other colors is omitted.

Figure 2:
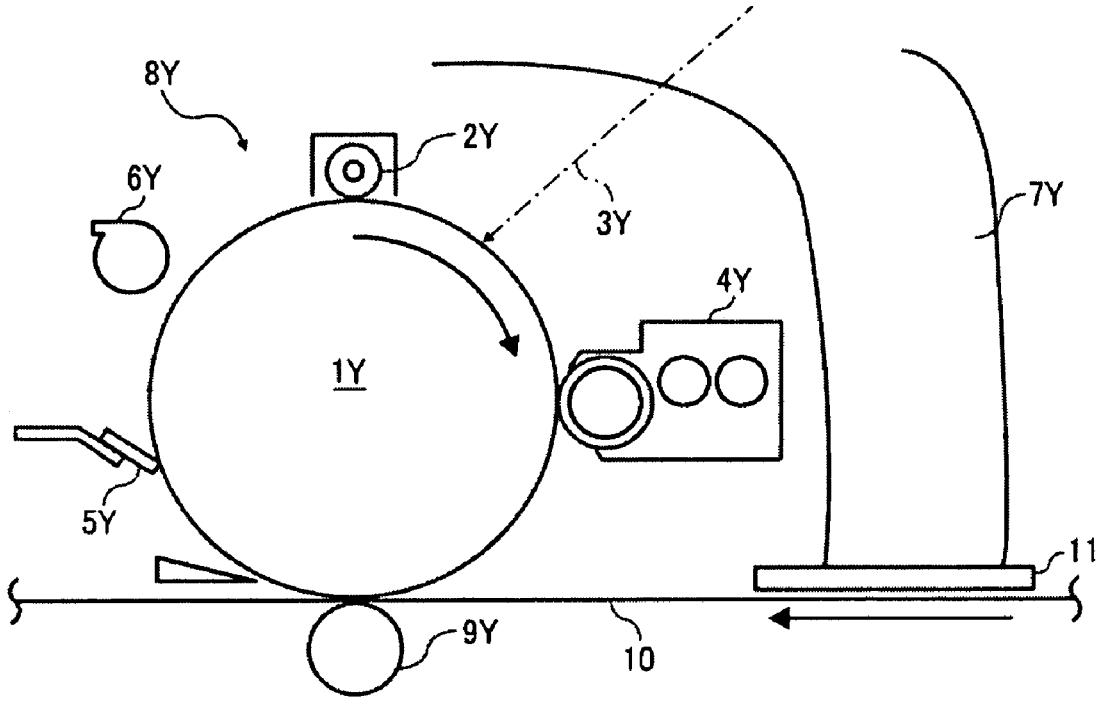
FIG. 2 is a diagram showing the outline structure of the toner image forming means.

FIG. 2 shows the outline structure of the toner image forming means. A charging device that includes a charging roller 2Y, a developing device 4Y, a drum cleaning device that includes a cleaning blade 5Y, and a decharging device 6Y are disposed in that order around the photosensitive member 1Y. These members are integrally supported in a frame 7Y, to form an image carrier unit 8Y.

In FIG. 2, the surface of the photosensitive member 1Y which is driven to rotate is uniformly charged by the charging roller 2Y, and scanned with laser light 3Y by an optical lighting device (not shown in the drawings) to form the electrostatic latent image for the Y color. The electrostatic latent image for the Y color is developed into a Y toner image by the developing device 4Y which contains Y developing agent. Then, the Y toner image is transferred onto the intermediate transfer belt 10 by the primary transfer roller 9Y. The cleaning blade 5Y removes residual toner from the surface of the photosensitive member 1Y after primary transfer. Also, the decharging device 6Y removes any remaining charge from the photosensitive member 1Y after cleaning. The surface of the photosensitive member 1Y is initialized by decharging, in preparation for the next image forming operation. In the toner image forming means for the other colors (M, C, Bk) also, toner images are formed on the photosensitive members (1M, C, Bk) in the same way, and primary transfer of the toner images onto the moving surface of the intermediate transfer belt 10 is carried out successively. In this way, a four color superimposed image (hereafter referred to as a four color toner image) is formed on the intermediate transfer belt 10.

The four color toner image on the intermediate transfer belt 10 is transported by the movement of the surface of the intermediate transfer belt 10 to the position in opposition to the secondary transfer roller 20, and secondary transfer of the four color toner image onto the surface of the recording medium fed between the secondary transfer roller 20 and the intermediate transfer belt 10 is carried out. After secondary transfer, the four color toner image is fixed onto the recording medium by the fixing device 21, to form a full color image.

On the other hand, secondary transfer residual toner that was not transferred onto the recording sheet P remains on the intermediate transfer belt 10 after secondary transfer. Here secondary transfer residual toner is toner that was not transferred during secondary transfer, and includes external additive components that have separated from the toner. Transfer residual toner of this kind is reverse transferred onto the surface of the photosensitive members 1 in the nip portion between the surface of the photosensitive member 1 and the intermediate transfer belt 10 when the next image is being formed. The matter reverse transferred onto the surface of the photosensitive member 1 is mechanically compressed by contact with the charging roller 3, the developing device 4, or the cleaning blade 5, and so on. As a result, the matter becomes fixed to the surface of the photosensitive member 1, and causes charging defects, interference with the light beam, and instability in the surface voltage of the photosensitive member. Therefore, faulty images are formed, such as black spots or white spots. Also, if adhering matter with high hardness becomes fixed on the photosensitive member 1, it cannot be removed by the edge of the cleaning blade 5 which cleans the surface of the photosensitive member 1. On the contrary, the edge of the cleaning blade becomes damaged or chipped, and transfer residual toner on the photosensitive member 1 can pass through the damaged part. This can cause image defects such as streaks.

Therefore a belt cleaning member 11 is provided in contact with the intermediate transfer belt 10 as intermediate transfer member cleaning means for cleaning the secondary transfer residual toner. In the image forming apparatus according to the present embodiment, the belt cleaning member 11 is provided upstream of the frame 7Y of the Y toner image carrier unit 8Y which is the most upstream toner image carrier unit 8 in the direction of movement of the surface of the intermediate transfer belt 10. By providing the belt cleaning member 11 in this position, it is possible to clean the intermediate transfer belt 10 upstream of the positions where the toner images for the next image are transferred onto the intermediate transfer belt 10 by the photosensitive members 1Y, M, C, Bk. Also, by providing the belt cleaning member 11 in the image carrier unit 8Y which includes the photosensitive member 1Y which normally is changed more frequently than the intermediate transfer belt 10, and changing the belt cleaning member 11 at the same time, replacement is simplified, and the occurrence of waste is reduced. The belt cleaning member 11 is only provided on the Y toner image carrier unit 8Y which is the toner image carrier unit 8 furthest upstream in the direction of movement of the surface of the intermediate transfer belt 10, and not provided on image carrier units 8M, C, and Bk.

Next, the belt cleaning member 11 is explained.

Figure 3:
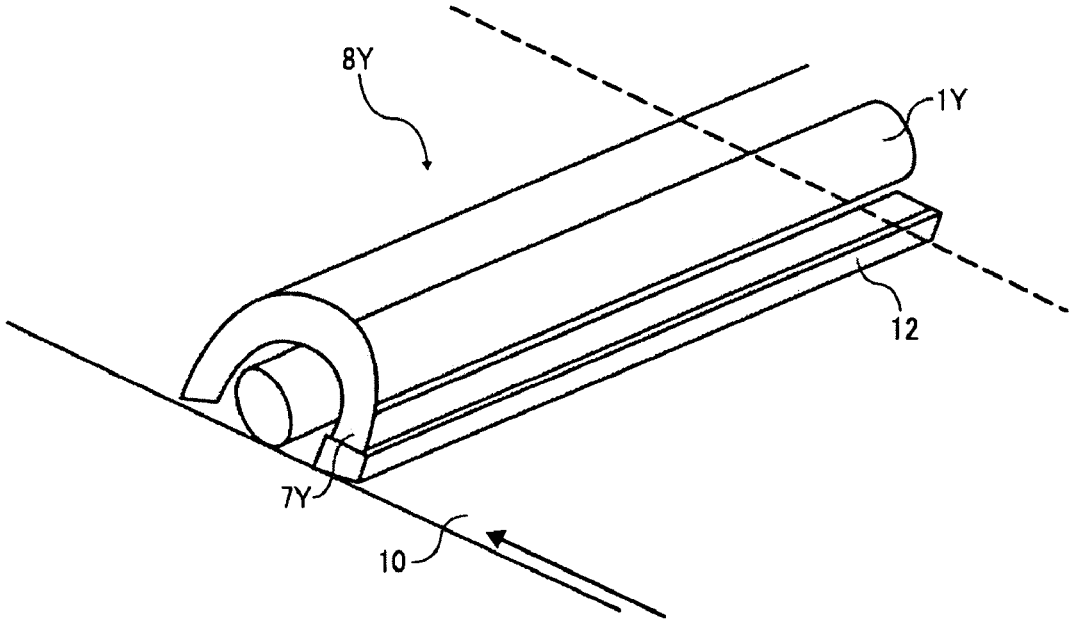
FIG. 3 is an external isometric view of the Y toner image carrier unit provided with an elastic blade.
Figure 4:
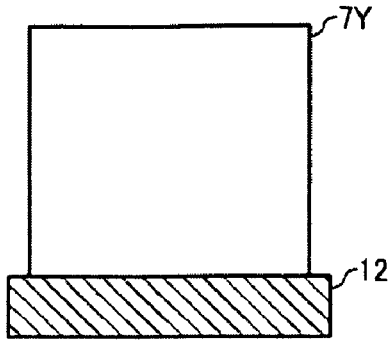
FIG. 4 is a front view of the Y toner image carrier unit provided with an elastic blade, viewed from the upstream side in the direction of movement of the intermediate transfer belt.

The belt cleaning member 11 may be an elastic blade commonly used as a cleaning blade. FIG. 3 shows the elastic blade 12 provided upstream of the frame 7Y of the Y toner image carrier unit 8Y. In FIG. 3 the toner image forming means is omitted. FIG. 4 is a diagram of the Y toner image carrier unit 8Y provided with the elastic blade 12, viewed from the upstream side in the direction of movement of the intermediate transfer belt 10. The elastic material can be selected as appropriate from among conventional commonly used thermoplastic resins, for example urethane, styrene, olefin, vinyl chloride, polyester, polyamide, fluorine, or other resins. The elastic blade is capable of stably cleaning transfer residual toner which has a comparatively broad distribution of particle diameters.

Figure 5:
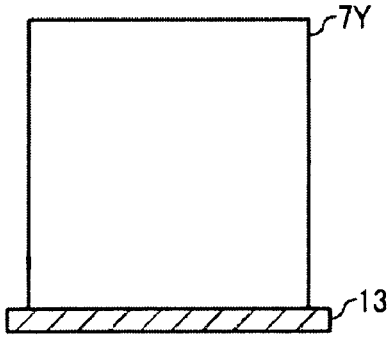
FIG. 5 is a front view of the Y toner image carrier unit provided with a fiber cloth, viewed from the upstream side in the direction of movement of the intermediate transfer belt.

Also, the belt cleaning member 11 may be changed as appropriate to suit the toner used. For example, there is toner with an inorganic external additive applied around a resin matrix to give fluidity, or toner to which internal or external wax additive adheres to improve the releasing properties. If this type of toner is used, then the transfer residual toner frequently contains external additive components that have separated, and which have particle diameters that are very small compared with the toner itself. Therefore, if a fiber cloth, such as for example polyester fiber, nylon fiber, cellulose fiber, polyethylene fiber, polypropylene fiber, rayon fiber, vinylon fiber, or pulp fiber, is used as the belt cleaning member 11, the effect of removing the very small particle diameters will be improved. FIG. 5 shows a Y toner image carrier unit 8Y provided with a fiber cloth 13, viewed from the upstream side in the direction of movement of the intermediate transfer belt 10. Furthermore, if a non-woven fabric such as a porous cloth material is used as the belt cleaning member 11, small diameter components will be absorbed within the pores, so it is possible to improve the removal effect. Also, porous cloth material is produced by compression, so the drop out of fibers from the belt cleaning member 11 is small, so the porous cloth does not become a source of contamination, and the cleaning effect is good.

Figure 6:
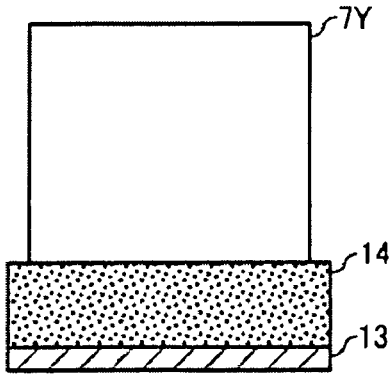
FIG. 6 is a front view of the Y toner image carrier unit provided with a fiber cloth with an elastic blade therebetween, viewed from the upstream side in the direction of movement of the intermediate transfer belt.

Furthermore, in order to increase the wiping power of the fiber cloth 13, as shown in FIG. 6, preferably an elastic material 14 is sandwiched between the fiber cloth 13 and the frame 7Y, to increase the pressure against the intermediate transfer belt 10. The elastic material 14 may be a urethane, polyester, polyamide, or fluorine resin, and so on, in rubber, sponge, or foam form, or the like. Among these, a sponge form for which the pressure can be easily adjusted is preferable.

When the elastic member 14 applies pressure to the surface of the intermediate transfer belt 10 in this way, if the pressure is not an appropriate value, then conversely there is a concern that the surface of the intermediate transfer belt 10 will be damaged, and toner components or external additive components will pass through the damaged area. Also, there is a possibility that the state of contact between the photosensitive member 1 and the intermediate transfer member 10 will be degraded. Specifically, if the contact between the photosensitive member 1 and the intermediate transfer belt 10 is insufficient, the transfer bias will be applied unevenly, which can result in the occurrence of image defects due to transfer defects. In order to prevent this type of occurrence, it is preferable to provide a belt cleaning member opposing roller on the reverse side of the intermediate transfer belt 10 in opposition to the belt cleaning member 11. By providing an opposing roller, the state of contact between the belt cleaning member 11 and the intermediate transfer belt 10 in opposition thereto is stabilized, so the performance in cleaning the intermediate transfer belt 10 is improved. The opposing roller may be made of either metal or resin.

Also, preferably the belt cleaning member 11 is removable with respect to the image carrier unit 8Y. In this way, the belt cleaning member 11 can be easily refreshed. Also, the belt cleaning member 11 can be replaced in accordance with the life of the image carrier unit, so it is possible to simply improve the maintainability.

Also, a resin endless belt has been used as the base member of the intermediate transfer belt 10. The material of the base member may be polyamide, PET, PVDF, or another commonly known material. The surface layer may be silicone rubber, urethane rubber, or a similar rubber layer. These form a stable nip at the location of secondary transfer, and allow transfer of a high quality toner image onto the recording medium.

Also, frequently the surface of the intermediate transfer belt 10 is damaged when mechanical pressure is applied. As a result of the unevenness in the surface caused by this damage, external additive or other small diameter components can pass by the belt cleaning member 11, which can cause vertical lines or similar on the images. In order to prevent this type of faulty image, when the image carrier units 8Y, M, C, Bk are being inserted into the main body of the image forming apparatus, the intermediate transfer belt 10 is separated, so that the intermediate transfer belt 10 is not in contact with the photosensitive members 1Y, M, C, Bk.

Also, second intermediate transfer member cleaning means may be disposed upstream of the Y toner image carrier unit 8Y in which the belt cleaning member 11 is provided. The second intermediate transfer member cleaning means may be the elastic blade 12 suitable for removing large particle diameter transfer residual toner. Then the belt cleaning member 11 may be the fiber cloth 13 suitable for removing very small diameter transfer residual toner. In this way, good cleaning is carried out in accordance with the particle diameter of the transfer residual toner, the speed at which the belt cleaning member 11 becomes dirty is reduced, so it is possible to extend its life. The second intermediate transfer member cleaning means may be a conventionally known device. Mainly elastic members are used, using thermoplastic resins such as urethane, styrene, olefin, vinyl chloride, polyester, polyamide, fluorine, or other resins.

According to the present embodiment as described above, the belt cleaning member 11 is provided on the upstream portion of the frame 7Y of the Y toner image carrier unit 8Y, which is disposed in the most upstream position and which can be removed from the main body of the image forming apparatus. In this way the belt cleaning member 11 can be easily replaced at the same time that the Y toner image carrier unit 8Y is replaced. Also, because normally their lives are shorter than that of the intermediate transfer belt 10, replacing the Y toner image carrier unit 8Y at the same time that the belt cleaning member 11 is replaced reduces the occurrence of waste of components compared with replacing the belt cleaning member 11 integrally with the intermediate transfer belt 10.

Also, by using an elastic blade 12 as the belt cleaning member 11, it is possible to stably clean transfer residual toner with a comparatively broad distribution of particle diameters.

Also, by using a fiber cloth 13 as the belt cleaning member 11, it is possible to improve the effect of removal of very small diameter components. This is particularly effective for obtaining good cleaning when the toner used contains significant quantities of external additive with small diameter particles, as the transfer residual toner also contains much small diameter external additive, and so on.

Also, the wiping effect of the fiber cloth 13 is improved by increasing the pressure against the intermediate transfer belt 10 with a belt cleaning member 11 in which the elastic member 14 is sandwiched between the fiber cloth 13 and the frame 7Y.

Also, by making the belt cleaning member 11 removable from the image carrier unit 8Y, the belt cleaning member 11 can be easily refreshed.

Also, when the image carrier units 8Y, M, C, Bk are being inserted into the main body of the image forming apparatus, the intermediate transfer belt 10 is separated so that the intermediate transfer belt 10 does not contact the photosensitive members 1Y, M, C, Bk. In this way, damage to the surface of the intermediate transfer belt 10 is prevented. Therefore the occurrence of vertical lines or similar on images due to external additive or other components passing by the belt cleaning member 11 through the unevenness in the surface of the intermediate transfer belt caused by this damage is prevented.

Also, the belt cleaning member 11 opposing roller is provided in opposition to the belt cleaning member 11 on the reverse side of the intermediate transfer belt 10. By providing the opposing roller, the contact state of the belt cleaning member 11 and the opposing intermediate transfer belt 10 is stabilized, so cleaning of the intermediate transfer belt 10 is improved.

Also, the second intermediate transfer member cleaning means is disposed upstream of the Y toner image carrier unit 8Y on which the belt cleaning member 11 is provided, to remove transfer residual toner from the intermediate transfer belt 10. In this way, the speed at which the belt cleaning member 11 becomes dirty is reduced, so its life is increased.

Also, the fiber cloth 13 is used as the belt cleaning member 11, and the elastic blade 12 is used as the second intermediate transfer member cleaning means. The elastic blade 12 on the upstream side removes transfer residual toner with comparatively large volume average diameter particles, and the fiber cloth 13 removes transfer residual toner that contains much external additive and other matter with small volume average diameter particles. In this way, good cleaning is obtained in accordance with the particle size of the transfer residual toner, and the speed at which the belt cleaning member 11 becomes dirty is reduced, so its life is extended.

According to the present invention as described above, in an image forming apparatus using a tandem type intermediate transfer member, the excellent effect that user maintainability and cost performance can be improved when replacing replaceable components can be obtained.

Various modifications will become possible for those skilled in the art after receiving the teachings of the present disclosure without departing from the scope thereof.

What is claimed is:

1. An image forming apparatus, comprising:

a plurality of image carrier units, each image carrier unit including an image carrier and a toner image forming means for forming respective toner images on the plurality of image carriers;

primary transfer means for transferring, successively, the toner images formed on the plurality of image carriers onto a moving surface of an intermediate transfer member, the plurality of image carrier units arranged individually such that a first of the plurality of image carriers units is disposed at a furthest upstream position with respect to a direction of movement of the surface of the intermediate transfer member;

secondary transfer means for transferring, in one operation, the toner images on the intermediate transfer member onto a recording medium; and intermediate transfer member cleaning means, which is in contact with the intermediate transfer member, for cleaning secondary transfer residual toner from the intermediate transfer member, the intermediate transfer member cleaning means being attached to a frame of the first of the plurality of image carrier units, wherein the plurality of image carrier units can each be individually removed from or inserted into a main body of the image forming apparatus.

2. The image forming apparatus as claimed in claim 1, wherein the intermediate transfer member cleaning means is an elastic blade.

3. The image forming apparatus as claimed in claim 1, wherein the intermediate transfer member cleaning means is a fiber member.

4. The image forming apparatus as claimed in claim 3, wherein the fiber member is attached to the frame of the first of the plurality of image carrier units with an elastic member disposed between the fiber member and the frame of the first of the plurality of image carrier units.

5. The image forming apparatus as claimed in claim 1, wherein the intermediate transfer member cleaning means is removable from the first of the plurality of image carrier units.

6. The image forming apparatus as claimed in claim 1, wherein when mounting the plurality of image carrier units on the main body, the intermediate transfer member is separated from the plurality of image carrier units.

7. The image forming apparatus as claimed in claim 1, wherein the intermediate transfer member is in a form of a belt, and a cleaning opposing roller is disposed opposite to the intermediate transfer member cleaning means on a reverse side of the intermediate transfer member.

8. The image forming apparatus as claimed in claim 1, wherein a second intermediate transfer member cleaning means for cleaning the intermediate transfer member is disposed upstream of the intermediate transfer member cleaning means relative to the direction of movement of the surface of the intermediate transfer member.

9. The image forming apparatus as claimed in claim 8, wherein the intermediate transfer member cleaning means is a fiber member, and the second intermediate transfer member cleaning means is an elastic blade.

10. The image forming apparatus as claimed in claim 1, wherein, when the first of the plurality of image carrier units is removed from or inserted into the main body of the image forming apparatus, the intermediate transfer member cleaning means is removed from or inserted into the main body of the image forming apparatus integrally with the first of the plurality of image carrier units.

11. The image forming apparatus as claimed in claim 1, wherein the intermediate transfer member cleaning means is attached to the frame of the first of the plurality of image carrier units at a position upstream of the image carrier of the first of the plurality of image carrier units with respect to the direction of movement of the surface of the intermediate transfer member.

12. An image forming apparatus comprising;

a plurality of image forming carrier units, each image carrier unit including an image carrier and a toner image forming means configured to form respective toner images on the plurality of image carriers;

a primary transfer means configured to transfer, successively, the toner images formed on the plurality of image carriers onto a moving surface of an intermediate transfer member, the plurality of image carrier units arranged individually such that a first of the plurality of image carriers units is disposed a furthest upstream with respect to a direction of movement of the surface of the intermediate transfer member;

a secondary transfer means configured to transfer, in one operation, the toner images on the intermediate transfer member onto a recording medium; and an intermediate transfer member cleaning means, which is in contact with the intermediate transfer member, configured to clean secondary transfer residual toner from the intermediate transfer member, the intermediate transfer member cleaning means being attached to a frame of the first of the plurality of image carrier units, wherein the plurality of image carrier units can each be individually removed from or inserted into a main body of the image forming apparatus.

* * * * *